US005141485A

United States Patent [19]

Welt

[11] Patent Number: 5,141,485

[45] Date of Patent: Aug. 25, 1992

[54] METHOD OF MAKING A FOLDER

[76] Inventor: Ralph E. Welt, 5 N. Roxbury, Hamburg, N.Y. 14075

[21] Appl. No.: 637,223

[22] Filed: Jan. 3, 1991

Related U.S. Application Data

[63] Continuation-in-part of Ser. No. 520,233, May 8, 1990, abandoned.

[51] Int. Cl.[5] ..... B31B 23/16; B31B 23/25; B31B 23/72; B42F 7/04

[52] U.S. Cl. ..... 493/210; 493/355; 493/947; 229/1.5 R; 229/68 R; 229/72; 281/31

[58] Field of Search ..... 493/210, 224, 228, 229, 493/231, 232, 347, 354, 355, 947; 229/1.5 R, 68 R, 72; 281/31

[56] References Cited

U.S. PATENT DOCUMENTS

| | | | |
|---|---|---|---|
| 1,408,509 | 3/1922 | Housh | 229/1.5 R |
| 1,473,294 | 11/1923 | Hutchison | 281/31 |
| 1,774,215 | 8/0930 | Weinthrop | 229/68 R |
| 3,070,279 | 12/1962 | Lutwack | 229/72 |
| 3,082,932 | 3/1963 | Lutwack | 229/72 |
| 3,372,858 | 3/1968 | Brody | 229/74 |
| 3,383,991 | 5/1968 | Sarka | 493/354 |
| 3,516,599 | 6/1970 | Buttery | 229/72 |
| 3,592,381 | 7/1971 | Brody | 229/74 |
| 3,826,422 | 7/1974 | Dickinson | 229/68 R |
| 3,851,762 | 12/1974 | Liblick | 206/425 |
| 4,046,257 | 9/1977 | Lehmacher | 493/210 |
| 4,306,737 | 12/1981 | Errichiello | 281/32 |
| 4,360,355 | 11/1982 | Suominen | 493/224 |
| 4,648,860 | 3/1987 | Cassey | 493/920 |
| 4,963,126 | 10/1990 | Jesch | 493/354 |

FOREIGN PATENT DOCUMENTS

| | | |
|---|---|---|
| 2316063 | 7/1985 | Fed. Rep. of Germany . |
| 14347 | 6/1983 | United Kingdom . |

*Primary Examiner*—William E. Terrell

*Attorney, Agent, or Firm*—Hodgson, Russ, Andrews, Woods & Goodyear

[57] ABSTRACT

A pocket for a folder and a method of making such a pocket and a folder having such a pocket more economically while also allowing ease and convenience of assembly by a customer and allowing a customer of a stationery shop greater flexibility in selecting a mix of folders with pockets and folders without pockets. The pocket has a panel and side and bottom tabs which are scored for folding easily. The pocket panel is disposed in position on a panel of the folder with the tabs between the pocket panel and folder panel, the bottom tab extending along the bottom edge of the folder panel and the side tab extending along a side edge of the folder panel, and the tabs adhesively attached to the folder panel to provide an opening to the pocket which extends along both the upper edge and a side edge thereof for conveniently putting papers therein. Double-coated pressure-sensitive adhesive tape is applied to the tabs and has a protective film on one side thereof which is peelable therefrom for adhesive attachment to the folder panel. The pockets are manufactured inexpensively by die-cutting and scoring a plurality thereof in a single die-cutting operation after the tape has been applied whereby the tape and blank may be cut as a unit so that the tape and tab edges are cleanly in conformity. The larger folders, being rectangular in shape, may be cut by the inexpensive guillotine-cutting process.

12 Claims, 2 Drawing Sheets

Fig. 1.
PRIOR ART
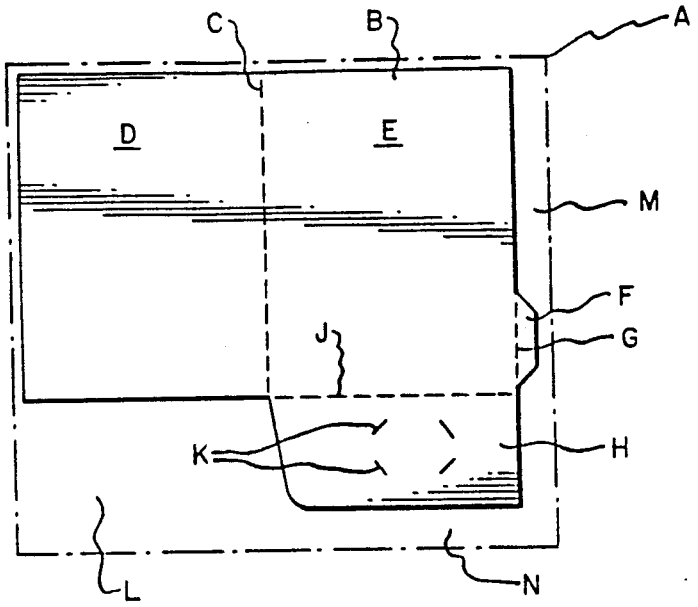
Fig. 2.
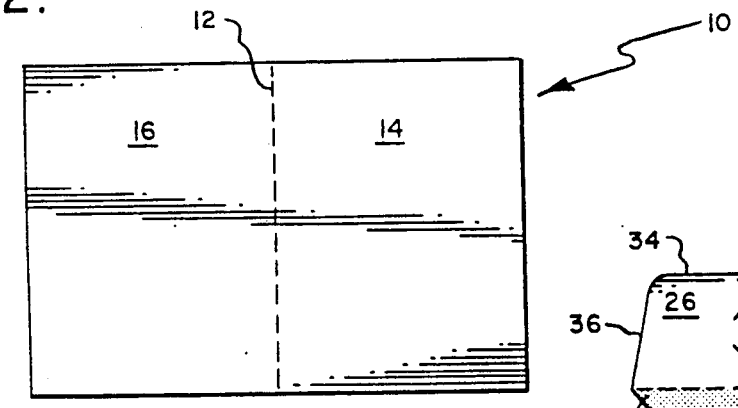
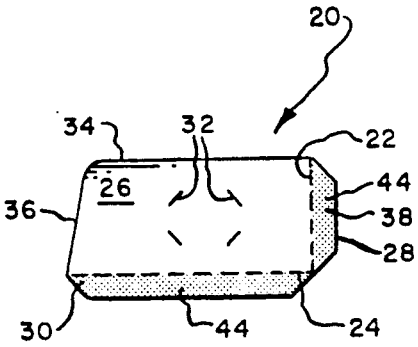
Fig. 3.
Fig. 4.
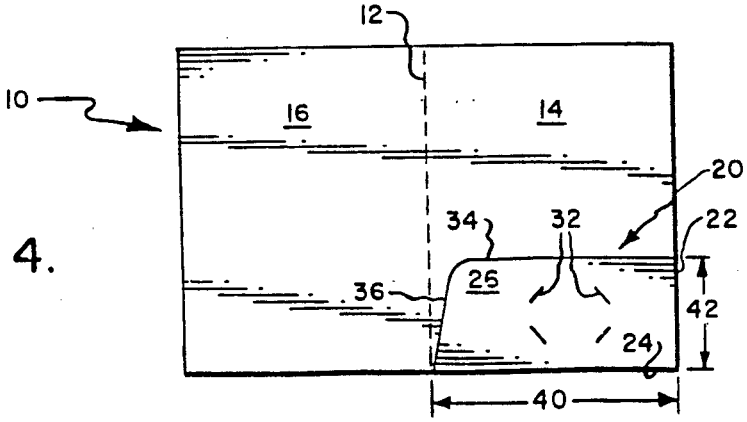

METHOD OF MAKING A FOLDER

This application is a continuation-in-part of co-pending U.S. patent application Ser. No. 07/520,233 filed May 8, 1990, abandoned.

The present invention relates to folders such as file folders used in an office environment. More particularly, the present invention relates to pockets for such folders for insertion of loose papers and to methods for making such pockets and folders.

File folders have commonly been provided wherein the pocket portion is integral with the folder. Such a folder is expensively manufactured as a single irregular-shaped sheet of cardboard which is folded to form the pocket. FIG. 1 illustrates a standard size piece of cardboard A from which an irregular-shaped sheet B may be die cut for forming the folder. The sheet B is folded along the fold line illustrated at C to define two generally rectangular panels D and E of a folder. A tab F extends outwardly from the lower side edge of panel E. The sheet B is folded at scored fold line G between the folder panel E and the tab F so that the tab F is disposed in overlying relation to the panel E. A portion H of the sheet B which extends downwardly from the panel E is provided to define a pocket panel. The sheet B is folded along scored fold line J so that pocket panel H is brought into overlying relationship with the lower portion of panel E as well as with tab F and is adhesively bonded to tab F to form a pocket which is open along the upper and a side edge thereof and extends over the width of the panel E for the insertion of papers. The tab F may alternatively be provided alongside the pocket panel H and adhesively attached to the folder panel E. Slits K may be provided in the pocket panel H for the insertion of a business card.

While such file folders having integral pockets serve well the function for which they are intended, they are expensive to manufacture. Thus, the die cutting for each irregular-shaped sheet B results in a substantial waste of cardboard, as illustrated at L in FIG. 1. While such a waste may be partially eliminated by providing a pocket for each of the panels D and E, this would not reduce the expense of manufacture, and an additional pocket may not be desired or required by a customer. Furthermore, since the cardboard from which folders are made comes in standard sizes, the requirements for the tab F and pocket panel H may require a larger standard size which would result in additional waste of material along the borders such as at M and N. It is thus considered desirable to reduce the waste of material in the manufacture of file folders with pockets so that the cost thereof may be reduced.

Since the integral pockets can only be produced in a like number relative to the quantity of the folders produced, such folders with integral pockets also do not provide for a suitable option to the customer of selecting a mix of folders without pockets and folders with pockets.

In the absence of a suitably inexpensive and effective option to convert folders without pockets to folders with pockets, in an effort to reduce cost a customer may wish to order a certain quantity of file folders without pockets and a lesser quantity of file folders with pockets, for example, 8,000 file folders without pockets and 2,000 file folders with pockets. However, if the pockets are integral with the file folders, such an order would require two different manufacturing processes and the increased cost associated therewith. Thus, undesirably, the order would have to be charged for as if it were two separate orders.

Furthermore, the irregular shape for the file folder sheets with integral pockets requires die cutting one at a time which is a more expensive cutting procedure than a guillotine-cutting process which allows stocks of perhaps 300 to 500 sheets at a time to be cut for making rectangular file folder sheets.

U.S. Pat. No. 1,408,509 to Housh discloses a sheet for loose-leaf books wherein pockets are separately formed and adhesively attached by means of a pair of tabs to adjacent edges of a leaf. Housh further discloses a layout for two generally triangular pockets wherein the flaps therefor are cut along a common hypotenuse so that there will be a minimum of waste in the cutting.

In order to successfully market a package of pockets so that a customer can apply them, they must not only be inexpensive but also easy and convenient to apply. Thus, a customer may not wish to apply an adhesive or to form folds in the pocket sheets in order to apply the pockets. Furthermore, the application of adhesive or formation of folds by a customer may not be sufficiently precise to result in a product of satisfactory quality.

Expensive separate pockets have been provided which comprise both front and back panels and closed sides and bottom wherein the back panel is adhesively attached to a file folder panel or the like. For example, a set of four self-adhesive file pockets sized 6 inches by $8\frac{3}{4}$ inches and various other sizes and composed of a plastic material have been marketed by Dahle, Oxford, Conn. 06483. Such pockets have a rear panel, as well as a front panel, which rear panel is adhesively attached over its entire surface to three-ring binders, bulletin boards, and the like and are closed along the bottom and both sides whereby their desirability for use as file folder pockets is reduced. The rear panel is provided with an adhesive coating and a backing sheet which is peelable therefrom for application. Such pockets, having more material than would be required if they did not have rear panels, may expensively retail at a price of perhaps $2.75 for a set of four sized $4\frac{1}{4}$ inches by $6\frac{1}{8}$ inches, which is believed to be too expensive for sales successfully for use as file folder pockets, even if such pockets were otherwise suitable for use. Larger sized pockets of this type would of course be even more expensive. When made of cardboard for use as file folder pockets, they remain expensive and may therefore be suitable only for more expensive and larger file folders. Again, such cardboard pockets, being closed along both sides, may not allow easy insertion of papers when used with conventional inexpensive file folders of the two-panel type.

U.S. Pat. No. 3,592,381 to Brody discloses a three-sided envelope device open at the top and adhesively applied by a pressure-sensitive adhesive to the book cover on three sides for library cards. A portion of an adhesive covering is peeled away along cuts therein for adhesive application to the book cover leaving a portion of the covering on the pocket face. Furthermore, such a pocket being for a library card, it extends over only a small portion of the width of the book surface, and, with both sides closed, would not conveniently allow insertion of various papers of a standard size even if it extended over the full width of a file folder panel.

Various other pockets for folders, notebooks, books, and the like are disclosed in U.S. Pat. Nos. 1,774,215 to Weinthrop, 3,070,279 and 3,082,932 to Lutwack, 3,516,599 to Buttery, 3,826,422 to Dickinson, 4,306,737 to Errichiello, 3,851,762 to Liblick, 3,372,858 and 3,592,381 to Brody, and 1,473,294 to Hutchison, U.K. patent document 14,347, and German patent document 2,316,063. Neither do any of these references appear to teach separate file folder pockets which can be manufactured inexpensively and which are convenient to use and apply.

Accordingly, it is an object of the present invention to provide a file folder pocket which is both inexpensive and may be easily and conveniently applied by a customer.

It is also an object of the present invention to provide an inexpensive manufacturing process for file folders with pockets which allows flexibility to the customer of a stationery shop in selecting a mix of file folders with pockets and file folders without pockets.

In accordance with the present invention, separate pockets for file folders are provided from sheets which are folded to provide a front panel, a side tab which is adhesively attached to a side edge of a file folder panel, and a bottom tab which is adhesively attached to the bottom edge of the file folder panel so that when the pocket is adhesively attached to the file folder panel, the file folder panel defines the rear of the pocket, and the pocket is open along both its top and a side edge for convenient insertion of papers. A double-coated pressure-sensitive adhesive tape is adhesively attached along one side to each of the tabs, and a protective film, applied on the other side of the tape, is peelable therefrom for adhesively attaching the tape to the folder panel so that the pocket may be easily and conveniently applied by a customer. A file folder pocket may be inexpensively manufactured in accordance with the present invention by die-cutting a plurality of pocket sheets in a single die-cutting operation whereby the cost per pocket sheet is minimized. A pocketed file folder may be inexpensively manufactured in accordance with the present invention by die-cutting a plurality of the relatively small pocket sheets in a single die-cutting operation and by cutting the larger folder sheets using the less expensive guillotine-cutting process.

Other objects, features, and advantages of the present invention will become apparent in the following detailed description of the preferred embodiments thereof which should be read in connection with the accompanying drawings.

Brief Description of the Drawings

FIG. 1 is a plan view illustrating the formation of a sheet for a file folder having an integral pocket from a standard size piece of cardboard according to the prior art.

FIG. 2 is a plan view of a sheet for forming a file folder.

FIG. 3 is a plan view of a sheet for forming a pocket for attaching to a panel of the file folder of FIG. 2 in accordance with the present invention.

FIG. 4 is a plan view illustrating the file folder of FIG. 2 with the pocket of FIG. 3 attached thereto.

Detailed Description of the Preferred Embodiments

Figure 5:
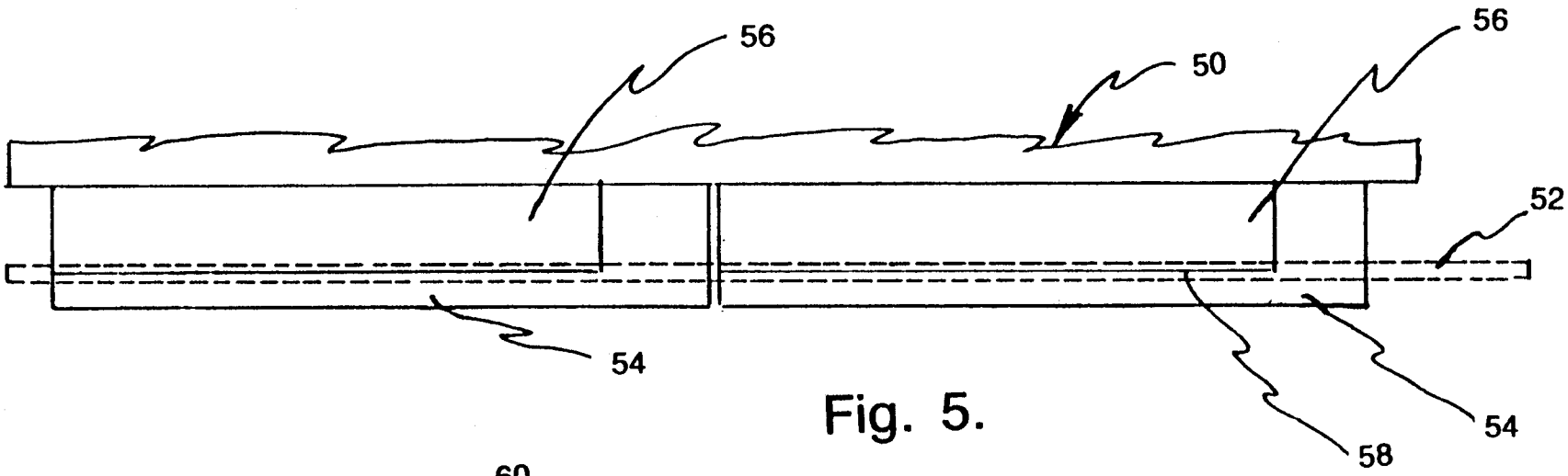
FIG. 5 is a schematic view illustrating the forming of the pocket of FIG. 3.

Referring to FIG. 2, there is shown at 10 a rectangular sheet of cardboard or heavy paper suitable for making a file folder. In order to form a file folder, the sheet 10 is folded along fold line 12 to form two identical rectangular panels 14 and 16. As known to those of ordinary skill in the art, the panels 14 and 16 need not be identical. For example, one of the panels may have a tab or the like for filing purposes.

Referring to FIG. 3, there is shown a sheet 20 for forming a pocket for the folder 10 of FIG. 2. The sheet 20 is generally rectangular and has a side scored fold line 22 and a bottom scored fold line 24 which define a generally rectangular front panel 26 for the pocket, a side tab 28, and a bottom tab 30. If desired, the front panel 26 may have suitable slits 32 for insertion of a business card. The folder panels 14 and 16 and the pocket panel 26 may have suitable printed material applied thereto as desired by the customer, although pocket panels are often not printed.

Referring to FIG. 4, there is shown the folder 10 with the pocket 20 applied to a panel 14 thereof. As the pocket 20 is illustrated in FIGS. 3 and 4, it is applied to the panel 14 by folding, along scored fold lines 22 and 24, the tabs 28 and 30 backwardly (away from the observer or into the paper as the drawings are shown) so that the scored fold lines 22 and 24 define the side and bottom edges respectively of the pocket 20 with the tabs 28 and 30 in underlying relationship to panel 26. The pocket 20 is then applied to the folder panel 14 with the bottom edge 24 aligned with the bottom edge of the panel 14 and with the side edge 22 aligned with the outer edge of the panel 14, and the tabs 28 and 30, being thus disposed to lie between the pocket panel 26 and the folder panel 14, are suitably adhesively attached to the folder panel 14. Thus, a pocket is defined between the panel 26 and the folder panel 14 which is closed along the bottom and one side or edge and which is open along the top 34 and the other side or edge 36 for convenient insertion of papers.

In order to provide for easy and convenient attachment of the pocket 20 to the folder, in accordance with the present invention the adhesive means comprises a double-coated tape 38 such as, for example, a type of tape marketed by Minnesota Mining and Manufacturing Company of St. Paul, Minn. as Double-Coated Tape No. 400. The tape 38 is adhesively attached to the pocket tabs 28 and 30, and a peelable protective covering or strip 44 may be left on the side of the tape which is to stick to the folder panel until it is desired to attach the pocket 20 at which time the protective member is peeled away from the tape for convenient adhesive attachment. The adhesive is preferably of the pressure-sensitive type so that, after the protective member 44 is peeled away, the pocket tabs 28 and 30 need only be applied under some slight pressure, which may perhaps be easily and conveniently exerted by a customer, to adhesively attach the pocket 20 to the folder 10.

As shown in FIG. 4, the pocket panel 26 preferably has a width, illustrated at 40, which is substantially equal to the width of the folder panel 14 for convenient insertion and retention of papers, i.e., width 40 is equal to at least about $\frac{3}{4}$ of the width of the panel 14. The side edge may extend over any height illustrated at 42 desired by the customer. Conventionally, height 42 may be perhaps between about 3 and 4 inches or perhaps $\frac{1}{3}$ of the height of the panel 14. The side edge 36 which along with the upper edge 34 defines the opening to the pocket may be chamfered inwardly, as illustrated in FIG. 4 and as is conventionally known in the art, that is, away from the folder fold line 12, to allow for easier insertion of papers.

Typically, panels 14 and 16 may have a width of perhaps 8½ to 9½ inches and a height of perhaps 11¼ to 12 inches in order to accommodate papers having a typical size of 8½ inches by 11 inches. For application to such folders, the pockets 20 may be provided to have a width 40 along the fold line 24 which is preferably between about 6 and 9 inches, more preferably between about 8½ and 9 inches. However, if the width of the folder panels is increased or decreased, the preferred size of the pocket panels 26 will accordingly increase or decrease.

The width of the tabs 28 and 30 may perhaps be in the range of ½ to ⅞ inch. The ends of the tabs 28 and 30 are chamfered at perhaps 45 degree angles to the fold lines, as shown in FIG. 3, so that, when the sheet 20 is folded, the tabs do not overlap each other or stick out from the panel 26.

The folders 10 and pockets 20 may be manufactured and sold separately to afford the customer flexibility in selecting the mix of folders with pockets and folders without pockets without the added expense of having to place two separate orders for folders. The pockets 20 may be sold as standard items for conversion by the customer of a standard folder without a pocket to one with a pocket thus eliminating the necessity of having to place a special order for a number of folders with pockets. Thus, the customer is afforded the opportunity to order the less expensive folders without pockets and inexpensively convert all or a portion thereof to folders with pockets. Alternatively, the manufacturer may at the customer's request apply the pockets to all or a portion of the folders manufactured for a net savings to the customer over the more expensive process of manufacturing folders with integral pockets.

By way of illustration only and not for purposes of limiting the present invention, the following is a typical or expected example of the breakdown in manufacturing cost for a file folder with a pocket wherein a comparison between the cost of manufacture of a file folder having an integral pocket according to the prior art and a file folder having a separate adhesively attached pocket according to the present invention is illustrated to illustrate the expected range of cost savings afforded by the present invention. For the purpose of this illustration, it is assumed that the customer has ordered 10,000 file folders, the panels of which are 8¾ inches by 12 inches and have pockets the height 42 of which is 3½ inch.

In order to manufacture such file folders with integral pockets of the prior art, such as illustrated in FIG. 1, the sheet B may have an overall width of about 18¼ inches and an overall length of about 15½ inches. Since cardboard or heavy paper for such purposes comes in standard sizes, typically 20 by 26 inches, 23 by 29 inches, 23 by 35 inches, 25 by 38 inches, 26 by 40 inches, and sometimes 19 by 25 inches and 24 by 36 inches, it may be necessary to achieve the greatest savings by using a standard size such as 23 inches by 35 inches and cutting them in half to a size of 17½ inches by 23 inches from which all of the sheets B are cut by the more expensive die-cutting process. For such integral folders, if you do not cut the sheets in half and instead die cut them 2 up, you also have to print them 2 up which requires a larger press for more expensive printing charges as well as higher die-cutting charges.

Assuming the use of 12 pt Springhill C1S (coated one side) paper, the major costs for manufacturing 10,000 printed file folders with integral pockets (which pockets are not printed, as is typical) may typically be as follows:

| | |
|---|---|
| 10,000 sheets 17½ by 23 inches at a cost of $127.68 per 1,000 ($127.68 × 10) | $1,277 |
| Printing 10,000 sheets (one color) at a speed of 5,000 per hour at a rate of $56.00 per hour ($56.00 × 2 hours) | 112 |
| Die cutting 10,000 sheets including scoring for fold lines at a cost of $69.00 per 1,000 sheets ($69.00 × 10) | 690 |
| Assembling 10,000 folders at a cost of $57.00 per 1,000 folders ($57.00 × 10) | 570 |
| TOTAL COST | $2,649 |

Figure 6:
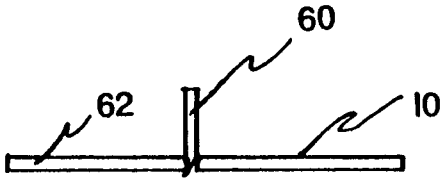
FIG. 6 is a schematic view illustrating the forming of the file folder of FIG. 2.

In order to make the same number of the same size folders in accordance with the present invention, the size of the folder sheet 10 may be 12 inches by 17½ inches, and the size of the pocket sheet 20 may be 9¼ inches by 4 inches. Stock of the same type paper having a standard size of 25 inches by 38 inches may be ordered and cut into sheets having a size of 19 inches by 25 inches (if this size is not otherwise available) from which to make both the folders and the pockets. In this case, two folder sheets 10 may be inexpensively printed and cut from a single 19 inch by 25 inch sheet using the less expensive guillotine-cutting process, illustrated schematically in FIG. 6 wherein a blank is severed by the guillotine member 60 into folder sheet 10 and a second sheet 62, and 10 pocket shapes 20 may be efficiently and therefore inexpensively die cut at one time from a single 19 inch by 25 inch sheet. Therefore, only 5,000 19 inch by 25 inch sheets are needed for cutting the folder by the less expensive guillotine process, and only 1,000 19 inch by 25 inch sheets are needed for die cutting the pockets. The major manufacturing costs for 10,000 folders with adhesively attached pockets in accordance with the present invention may be estimated to be typically as follows:

| | |
|---|---|
| 6,000 sheets 19 inches by 25 inches at a cost of $150.48 per 1,000 ($150.48 × 6) | $903 |
| Printing 5,000 sheets at a speed of 5,000 per hour (one color, folders only, run 2 up) at a rate of $56.00 per hour ($56.00 × 1 hour) | 56 |
| Guillotine cutting 5,000 sheets to form 10,000 folder sheets | 32 |
| Die cutting of 1,000 sheets to provide 10,000 pockets at $105.00 per 1,000 sheets of stock ($105.00 × 1) | 105 |
| Machine folding 10,000 folders 1 up at 6,000 per hour at $37.00 per hour plus 18 minutes set up | 74 |
| Applying tape to 10,000 pockets at $30.00 per 1,000 ($30.00 × 10) | |
| Folding and applying 10,000 pockets to 10,000 folders at $30.00 per 1,000 ($30.00 × 10) | 300 |
| TOTAL COST | $1,770 |

There may of course be additional miscellaneous costs in addition to those listed which would normally be expected to be the same for either process. Thus, while the total cost for each process may be higher than as illustrated, the difference in cost would remain the same. By comparing the estimated typical cost for 10,000 file folders with integral pockets according to the prior art with 10,000 similar file folders with adhesively attached pockets according to the present invention, it is seen that the average cost per file folder according to the present invention may be decreased by roughly $0.09 per folder. This represents a very substantial cost saving when it is considered that file folders with integral pockets have a typical manufacturing cost of about $0.40 apiece when ordered in a quantity of 10,000. For the customer who wishes to assemble the pockets and file folders himself or herself, it is estimated that 10,000 such pocket sheets (scored but unfolded) may typically cost about $600.00 or about $0.06 apiece to produce, which would allow them to be retailed at a price significantly lower than a price of $0.68 apiece at which the aforesaid Dahle pockets may retail. This would allow the customer to reduce his or her cost substantially while at the same time allowing flexibility in his or her selection of a mix of folders with pockets and folders without pockets.

It is considered desirable that the tape be applied over the entire surface of each of the tabs. Application of the tape 38 after the pocket sheets are cut does not allow edges that conform evenly to the tab edges and thus may of necessity require the manufacturer to use tape portions which do not cover the entire tab surface. This may result in unadhered overlapping tab edges which may undesirably tend to cause the pockets to become detached or adversely affect the pocket performance during use. In order that the tape may both cover substantially the entirety of the tab surface area and have edges that conform evenly to the tab edges so as not to overlap, in accordance with a preferred embodiment of the present invention the tape 38 for the plurality of pockets is applied on the blank prior to the die cutting of the pocket sheets 20 therefrom whereby the tape, which is preferably slightly oversize, and blank may be cut as a unit so that their edges are in conformity, as illustrated in FIG. 3, whereby they do not have overlapping edges.

In order to appropriately position the tape 38 on the blank, the blank may first be printed with guidelines for the plurality of pocket patterns, to be subsequently cut therefrom, showing the tab positions, and the tape may then be applied by hand. Alternatively, in order to reduce costly manual labor and to eliminate the necessity of printing the blank, the tape may be applied automatically by a machine which is programmed with the tab positions.

Referring to FIG. 5, after the tape 38 is applied, the die, illustrated schematically at 50, is suitably positioned, and the plurality of pocket sheets 20 are die cut from the sheet or blank 52 by die members 54 cutting entirely therethrough while simultaneously the sheets 20 are scored by die members 56 of the die-cutting machine by appropriately reducing the depth of cut, as illustrated at 58, so that die members 56 do not cut entirely through the sheet 52, in accordance with principles commonly known to those of ordinary skill in the art to which this invention pertains. The scored fold lines 22 and 24 allow the pockets to be packaged flat for advantageously more compact packaging while providing ease and convenience to the customer for folding the pockets for use.

Since the pockets are not integral with the file folders 10, which are commonly and suitably rectangular in shape, the larger folders 10 may advantageously be cut from a blank by the less expensive guillotine-cutting process and provided with fold line 12 in a manner commonly known to those of ordinary skill in the art to which this invention pertains.

Since the die-cutting and guillotine-cutting processes and machines therefor are conventional processes and machines commonly known to those of ordinary skill in the art to which this invention pertains, it is not believed necessary to describe them in any greater detail herein.

Thus, in addition to making the manufacture of folder pockets and of folders with pockets more economical as well as allowing ease and convenience of assembly, the present invention wherein the pocket is made separate from the folder and adhesively attached thereto with double-coated pressure-sensitive adhesive tape affords an opportunity for the small buyer of printing to buy pockets at a low cost and any quantity his or her customer needs, such as perhaps 6 or more, since the pockets can be produced in quantity generically and stored for sale and use at a later time. Thus, the customer is allowed greater flexibility in folder selection at a lower cost.

It is to be understood that the invention is by no means limited to the specific embodiments which have been illustrated and described herein and that various modifications thereof may indeed be made which come within the scope of the present invention as defined by the appended claims.

What is claimed is:

1. A method of making a pocket for application to a folder panel comprising a. die-cutting a sheet for application to the folder panel in a process in which a plurality of the sheets are formed in a single die-cutting operation;

b. forming in the sheet, in said single die-cutting operation fold lines defining a pocket panel, a bottom tab for attachment along a bottom edge of the folder panel, and a side tab for attachment along a side edge of the folder panel; and c. applying to each of said tabs double-coated pressure-sensitive adhesive tape having a protective film on one side thereof which is peelable therefrom for adhesive attachment to the folder panel.

2. A method according to claim 1 further comprising sizing the pocket panel to have a width which is equal to at least about 6 inches.

3. A method according to claim 1 further comprising sizing the pocket panel to have a width which is equal to between about 8½ and 9½ inches.

4. A method according to claim 1 wherein the tape is applied before die-cutting the sheet.

5. A method according to claim 4 wherein the step of applying the tape comprises providing the tape to cover substantially the entirety of the surface of the corresponding tab and to overlie the corresponding positions for cutting of the tab edges whereby the tape and sheet are cut simultaneously to provide conforming edges which do not overlap each other.

6. A method of making a folder which has a pocket comprising the step of:

a. guillotine-cutting a generally rectangular first sheet;

b. folding the first sheet along a fold line to form at least two generally rectangular folder panels each having a side edge which is generally parallel to said fold line, a top edge, and a bottom edge;

c. die-cutting a second sheet in a process in which a plurality of the second sheets are formed in a single die-cutting operation;

d. forming, in said single die-cutting operation, fold lines in the second sheet to define a pocket panel, a bottom tab, and a side tab;

e. applying to each of the tabs double-coated pressure-sensitive adhesive tape having a protective film on one side thereof which is peelable therefrom for adhesive attachment to one of the folder panels;

f. peeling the strip from the tape;

g. folding the second sheet along the fold lines and disposing the second sheet with the tabs disposed to lie between a folder panel and the pocket panel and with the bottom tab extending along the bottom edge of said folder panel and the side tab extending along the side edge; and h. pressing the tabs to the folder panel to bond said tabs thereto and to thereby form a pocket for receiving papers between the folder panel and the pocket panel.

7. A method according to claim 6 further comprising sizing the pocket panel to have a width which is substantially equal to the width of the folder panel.

8. A method according to claim 6 further comprising applying the second sheet to the first sheet to provide an opening to the pocket which extends along both an upper edge and a side edge thereof wherein the opening faces the folder fold line and the upper edge of the folder panel.

9. A method according to claim 6 further comprising sizing the pocket panel to have a width which is equal to at least about 6 inches.

10. A method according to claim 6 further comprising sizing the pocket panel to have a width which is equal to between about $8\frac{1}{2}$ and $9\frac{1}{2}$ inches.

11. A method according to claim 6 wherein the tape is applied before die-cutting the second sheet.

12. A method according to claim 11 wherein the step of applying the tape comprises providing the tape to cover substantially the entirety of the surface of the corresponding tab and to overlie the corresponding positions for cutting of the tab edges whereby the tape and second sheet are cut simultaneously to provide conforming edges which do not overlap each other.

* * * * *